US009923277B2

(12) United States Patent
Baek et al.

(10) Patent No.: US 9,923,277 B2
(45) Date of Patent: Mar. 20, 2018

(54) ANTENNA AND EMISSION FILTER

(71) Applicant: SAMSUNG ELECTRONICS CO., LTD., Suwon-si (KR)

(72) Inventors: Kwang-hyun Baek, Anseong-si (KR); Alexander Goudelev, Suwon-si (KR); Won-bin Hong, Seoul (KR); Young-ju Lee, Seoul (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 289 days.

(21) Appl. No.: 14/258,788

(22) Filed: Apr. 22, 2014

(65) Prior Publication Data

US 2014/0313096 A1 Oct. 23, 2014

(30) Foreign Application Priority Data

Apr. 22, 2013 (KR) ..... 10-2013-0044465

(51) Int. Cl.
*H01Q 1/38* (2006.01)
*H01Q 15/00* (2006.01)

(52) U.S. Cl.
CPC ..... *H01Q 15/006* (2013.01); *H01Q 1/38* (2013.01)

(58) Field of Classification Search
CPC ..... H01Q 15/006; H01Q 1/38; H01Q 1/526
See application file for complete search history.

(56) References Cited

U.S. PATENT DOCUMENTS

| | | | | |
|---|---|---|---|---|
| 6,496,155 | B1 | 12/2002 | Sievenpiper et al. | |
| 6,853,350 | B2 * | 2/2005 | Alexopoulos | H01P 1/2005 343/700 MS |
| 7,847,737 | B2 | 12/2010 | Kuroda | |
| 8,035,991 | B2 | 10/2011 | Kim et al. | |
| 2003/0011518 | A1 | 1/2003 | Sievenpiper et al. | |
| 2003/0071763 | A1 * | 4/2003 | McKinzie, III | H01Q 9/0421 343/909 |
| 2006/0214855 | A1 | 9/2006 | Harada et al. | |
| 2010/0039343 | A1 | 2/2010 | Uno et al. | |

FOREIGN PATENT DOCUMENTS

| | | | |
|---|---|---|---|
| JP | 7-53290 | Y2 | 12/1995 |
| JP | 3932767 | B2 | 6/2007 |

* cited by examiner

*Primary Examiner* — Graham Smith
*Assistant Examiner* — Noel Maldonado
(74) *Attorney, Agent, or Firm* — Sughrue Mion, PLLC

(57) ABSTRACT

An antenna and emission filter are provided. The antenna includes a substrate; an emitter on a substrate wherein the emitter is configured to emit electromagnetic signals; a feeding portion connected to the emitter; and an emission filter comprising a plurality of emission filter cells formed on the substrate in order to filter a surface wave caused by the emitter, wherein each of the plurality of emission filter cells comprises an inductor pattern portion electrically connected with an adjacent emission filter cell to form an inductor; and a capacitor pattern portion distanced from the adjacent emission cell to form a capacitor.

19 Claims, 15 Drawing Sheets

ANTENNA AND EMISSION FILTER

CROSS-REFERENCE TO RELATED APPLICATIONS

This application claims priority from Korean Patent Application No. 10-2013-0044465, filed in the Korean Intellectual Property Office on Apr. 22, 2013, the disclosure of which is incorporated herein by reference, in its entirety.

BACKGROUND

1. Field

Methods and apparatuses consistent with the exemplary embodiments relate to an antenna and emission filter. More particularly, the exemplary embodiments relate to an antenna and emission filter configured to reduce a surface wave.

2. Description of the Prior Art

The biggest issue in developing an antenna is to reduce the side lobe and thus maximize the main lobe, which relates to improving the performance of the antenna. In particular, the surface wave which occurs at the edge side of an array antenna functions as a side lobe that deteriorates the performance of the antenna.

To this end, in the past, a method of amplitude tapering has been used. This method increases the main lobe by adjusting the amplitude of the feeding signal of an array antenna. However, such a method requires controlling the gain regarding the PA (Power Amplifier) and LNA (Low Noise Amplifier) connected to the antenna. Therefore, there was a problem relating to increased power consumption.

There was also a method of increasing the main lobe by adjusting the distance between each antenna element of an array antenna. However, it is very difficult to appropriately adjust the distance between each antenna element. In addition, when the distance between each antenna element increases, an Aliasing effect may occur where it becomes difficult to distinguish between the main lobe and the side lobe, and when the distance between each antenna element decreases, a Coupling effect may occur where interruptions occur between neighboring antennas.

SUMMARY

A purpose of the exemplary embodiments is to provide an antenna and emission filter configured to reduce a surface wave.

According to an exemplary embodiment, an antenna comprises a substrate; an emitter on a substrate configured to emit electromagnetic signals; a feeding portion connected to the emitter; and an emission filter having a plurality of emission filter cells formed on the substrate, to filter a surface wave caused by the emitter, wherein each of the plurality of emission filter cells includes an inductor pattern portion electrically connected with an adjacent emission filter cell in order to form an inductor; and a capacitor pattern portion distanced from the adjacent emission cell to form a capacitor.

In addition, the plurality of emission filter cells may include a conductive pattern of a same shape formed on the substrate surface.

Furthermore, the emitter may include a plurality of emitter cells formed on the substrate, and at least one emitter filter cell from among the plurality of emission filter cells may be arranged among the plurality of emitters.

In addition, the emitter may be formed in a Via hole which is formed on the substrate.

In addition, the substrate may include a plurality of substrates deposited on top of one another, the emitter may include a plurality of emitter cells, and the antenna may further include: a dielectric portion formed among the plurality of substrates; a via hole formed inside the dielectric portion; and a feeding line formed inside the via hole in order to electrically connect an upper emitter cell located in an upper side of the dielectric portion and a lower emitter cell located in a lower side of the dielectric portion.

In addition, the substrate may include a plurality of substrates deposited on top of one another, the emitter may include a plurality of emitter cells, and the antenna may further include a dielectric portion formed among the plurality of substrates.

In addition, each of the plurality of emission filter cells may be one of a circular, oval, or polygonal shape.

According to an exemplary embodiment, an emission filter may include a substrate; and a plurality of emission filter cells configured in a conductive pattern on the substrate, in order to filter a surface wave caused by the emitter, wherein each of the plurality of emission filter cells includes an inductor pattern portion electrically connected with an adjacent emission filter cell to form an inductor; and a capacitor pattern portion distanced from the adjacent emission filter cell to form a capacitor.

In addition, the plurality of emission filter cells may consist of a conductive pattern of a same shape formed on the substrate surface.

Furthermore, each of the plurality of emission filter cells may be one of a circular, oval or polygonal shape.

An aspect of an exemplary embodiment may further provide an antenna including: an emitter configured to emit electromagnetic signals; and an emission filter including a plurality of emission filter cells functioning as a band stop filter and configured to filter a surface wave caused by the emitter, wherein each of the plurality of emission filter cells includes an inductor pattern portion electrically connected with an adjacent emission filter cell to form an inductor; and a capacitor pattern portion distanced from the adjacent emission cell to form a capacitor. The antenna may further include a substrate.

The substrate may be a plurality of substrates deposited on top of one another and the emitter may be formed on the substrate.

The antenna may further include a feeding portion connected to the emitter. The plurality of emission filter cells may be formed on the substrate in order to filter a surface wave caused by the emitter.

The antenna may further include a dielectric portion formed among the plurality of substrates.

In addition, each of the plurality of emission filter cells may be one of a circular, oval or polygonal shape.

The emitter may be formed in a via hole formed on the substrate. The antenna may further include a feeding line formed inside the via hole to electrically connect an upper emitter cell located in an upper side of the dielectric portion and a lower emitter cell located in a lower side of the dielectric portion.

According to the various exemplary embodiments, a surface wave may be reduced thereby improving the performance of the antenna.

BRIEF DESCRIPTION OF THE DRAWINGS

The above and/or other aspects of the exemplary embodiments will be more apparent by describing the disclosure with reference to the accompanying drawings, in which.

DETAILED DESCRIPTION

Certain exemplary embodiments are described below in greater detail with reference to the accompanying drawings.

Figure 1:
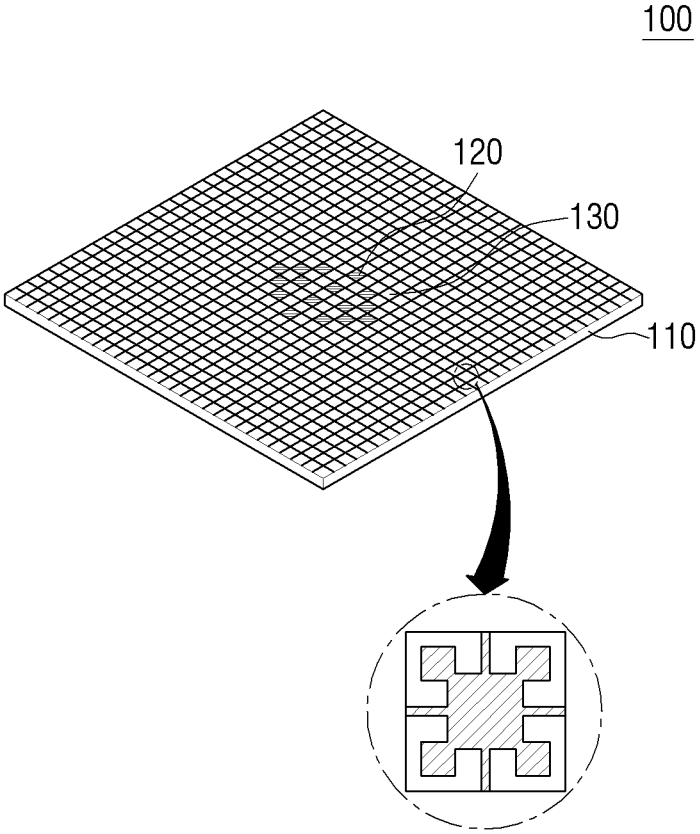
FIG. 1 is a perspective view of an antenna according to an exemplary embodiment.
Figure 2:
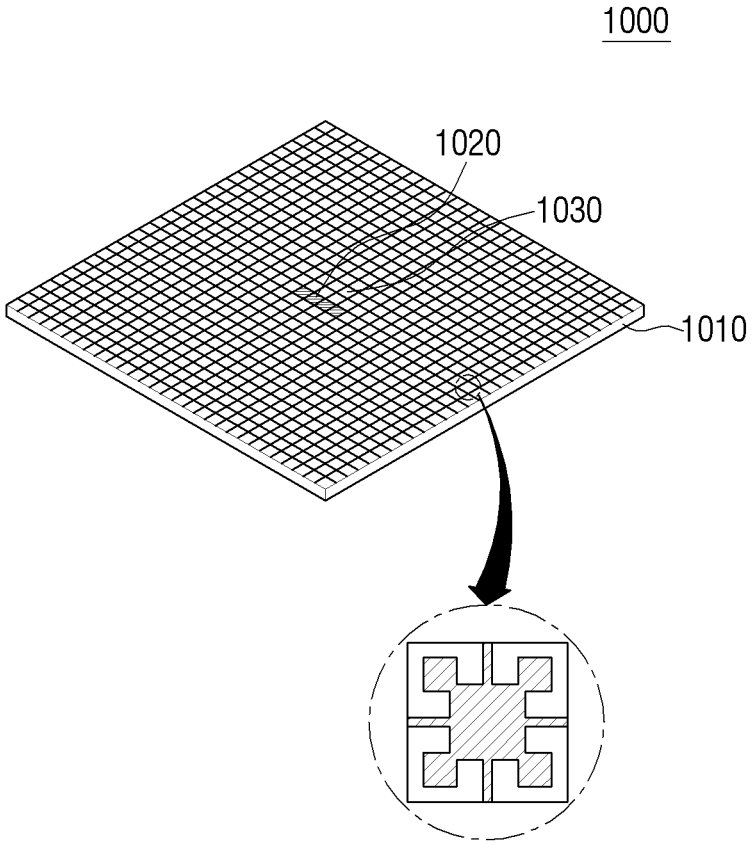
FIG. 2 is a perspective view of an antenna according to another exemplary embodiment.

FIGS. 1 and 2 are perspective views of an antenna 100 according to various exemplary embodiments.

With reference to FIG. 1, an antenna 100 according to an exemplary embodiment includes a substrate 110, an emitter, a feeding portion (not illustrated), and an emission filter.

On the substrate 110, the emitter and emission filter may be disposed, while on the opposite surface of the substrate 110 where the emission filter is disposed, the feeding portion (not illustrated) may be disposed. Since the emitter disposed on the substrate 110 is a conductive material, the substrate 110 may be made of a nonconductive material.

The feeding portion (not illustrated) supplies electromagnetic energy to the emitter. In this case, the feeding portion (not illustrated) may supply electromagnetic energy to the emitter through a feeding line. Detailed explanation on such a feeding line will be made hereinbelow. The feeding portion (not illustrated) may be disposed on the emitter on the substrate 110 of the opposite side based on the substrate 110, or on a lateral side of the substrate. Not only that, the feeding line that connects the emitter and the feeding portion (not illustrated) may be formed on the substrate 110, and the feeding portion (not illustrated) may be disposed on another part besides the substrate 110.

The emitter is formed on the substrate 110 and emits electromagnetic signals. The emitter is connected with the feeding portion (not illustrated) placed on the opposite side of the emitter based on the substrate 110. The feeding portion (not illustrated) may supply electromagnetic energy to the emitter, and an emitter which receives the electromagnetic energy may emit electromagnetic signals in the form of electromagnetic waves. As illustrated in FIG. 1, the emitter may include a plurality of emitter cells 120 formed on the substrate 110, and the plurality of emitter cells 120 may be disposed on the substrate 110 in various ways, according to the desired emission pattern. Therefore, various exemplary embodiments may be derived according to the pattern in which the plurality of emitter cells 120 are disposed.

The emission filter is disposed on the substrate 110 and on the same surface as the surface where the emitter is disposed. Such an emission filter may consist of a plurality of emission filter cells 130 formed on the substrate 110. As illustrated in FIG. 1, on the substrate 110, a plurality of emission filter cells 130 may be disposed, and the plurality of emission filter cells 130 may be disposed around the emitter cells 120. That is, at least one emission filter cell 130 from among the plurality of emission filter cells 130 may be disposed among the plurality of emitter cells 120. Therefore, around one emitter cell 120, a plurality of emission filter cells 130 may be disposed, preferably on an adjacent portion in 4 directions on a flat surface of the one emitter cell 120. In some cases, an emitter cell 120 or emission filter cell 130 may not be disposed among the plurality of emission filter cells 130.

A illustrated in FIG. 1, each of the plurality of emission filter cells 130 may include a same conductive pattern formed on the substrate 110 surface, and may include both an inductor pattern portion and a capacitor pattern portion. That is, the inductor pattern portion and capacitor pattern portion may be those patterned of conductive material and may be formed on the nonconductive substrate 110. Therefore, the one emission filter cell 130 may be one where a conductive pattern is formed including the inductor pattern portion and the capacitor pattern portion on an upper surface of the nonconductive substrate 110. Detailed explanation on the inductor pattern portion and the capacitor pattern portion will be made hereinbelow.

With reference to FIG. 2, an antenna 1000 according to another exemplary embodiment includes one Monopole antenna 1020. That is, at least one Monopole antenna 1020 may be disposed on the substrate 1010, and a plurality of emission filter cells 1030 may be adjacently disposed around the Monopole antenna 1020. In this case, the at least one Monopole antenna 1020 may be disposed in a direction parallel to the substrate 1010 or in a direction perpendicular to the substrate 1010, as illustrated in FIG. 2.

Such an emission filter may perform filtering on surface waves caused by the emitter. Herein, a surface wave may be a side lobe that the antenna emits, and filtering a surface wave may mean reducing or removing the side lobe that the antenna emits, thereby improving performance of the antenna.

Figure 3:
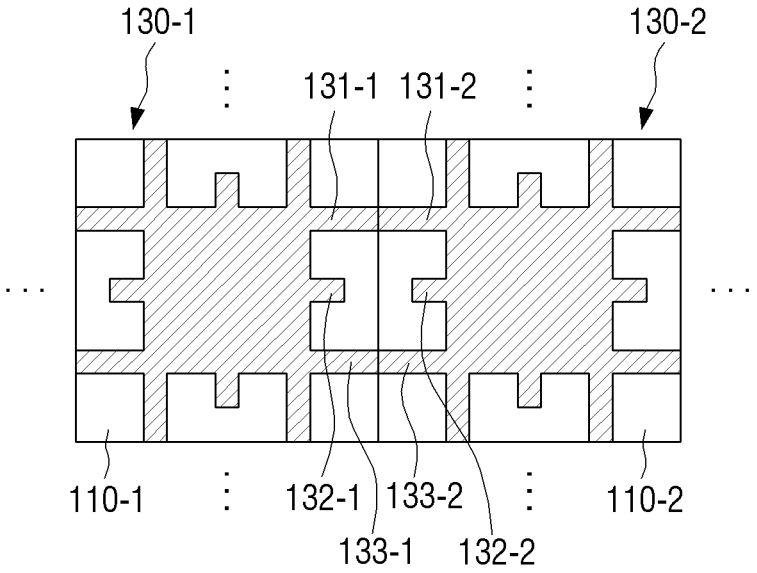
FIG. 3 is a plan view of an emission filter according to an exemplary embodiment.

FIG. 3 is a plan view of an emission filter according to an exemplary embodiment. Hereinbelow, explanations related to portions overlapping the aforementioned explanations are omitted.

With reference to FIG. 3, an emission filter according to an exemplary embodiment includes substrates 110-1, 110-2 and a plurality of emission filter cells. FIG. 3 illustrates a first emission filter cell 130-1 and a second emission filter cell 130-2. Only a plurality of emission filter cells may be disposed adjacent to the first emission filter cell 130-1 and the second emission filter cell 130-2. In such a case, the plurality of emission filter cells may consist of a conductive pattern of a same shape.

FIG. 3 illustrates the first emission filter cell 130-1 and the second emission filter cell 130-2. The first emission filter cell 130-1 and the second emission filter cell 130-2 are made in a same shape, and thus, hereinbelow, explanation of overlapping portions regarding each emission filter cell will be omitted.

The first emission filter cell 130-1 may have a square shape and may consist of a conductive pattern on a nonconductive substrate 110-1, 110-2. At one side of the first emission filter cell 130-1, an inductor pattern portion and a capacitor pattern portion may be formed. In addition, the conductive pattern of the first emission filter cell 130-1 may be symmetrical around a vertical axis direction and around a horizontal axis direction. Therefore, at each of the 4 lateral sides of the first emission filter cell 130-1, an inductor pattern portion and a capacitor pattern portion may be formed.

The inductor pattern portion is electrically connected to the conductive pattern of the adjacent emission filter cell thereby forming an inductance to play the role of an inductor. With reference to FIG. 3, at a right side of the first emission filter cell 130-1, a 1-1 inductor pattern portion 131-1 and a 1-2 inductor pattern portion 133-1 are formed, while at a left side of the second emission filter 130-2, a 2-1 inductor pattern portion 131-2 and a 2-2 inductor pattern portion 133-2 are formed. Since the first emission filter cell 130-1 and the second emission filter cell 130-2 are adjacent to each other, the 1-1 inductor pattern portion 131-1 and the 2-1 inductor pattern portion 131-2, the 1-2 inductor pattern portion 133-1 and the 2-2 inductor pattern portion 133-2 are electrically connected to each other. Therefore, by the 1-1 inductor pattern portion 131-1 and the 2-1 inductor pattern portion 131-2 electrically connected to each other, a first inductance is formed. By the 1-2 inductor pattern portion 133-1 and the 2-2 inductor pattern portion 133-2 electrically connected to each other, a second inductance is formed. In this case, by adjusting a length and/or width of the inductor pattern portion, it is possible to set an inductance.

The capacitor pattern portion is electrically distanced from the conductive pattern of the adjacent inductive emission filter cell to play the role of a capacitor. With reference to FIG. 3, at a right side of the first emission filter cell 130-1, a first capacitor pattern portion 132-1 is formed, while at a left side of the second emission filter 130-2, a second capacitor pattern portion 132-2 is formed. The first emission filter cell 130-1 and the second emission filter cell 130-2 are adjacent to each other, but the first capacitor pattern portion 132-1 and the second capacitor pattern portion 132-2 are electrically distanced from each other. Therefore, by the electrically distanced first capacitor pattern portion 132-1 and the second capacitor pattern portion 132-2, a capacitance is formed. In this case, by adjusting the length and/or width of the capacitor pattern portion, it is possible to determine the capacitance.

Figure 4:
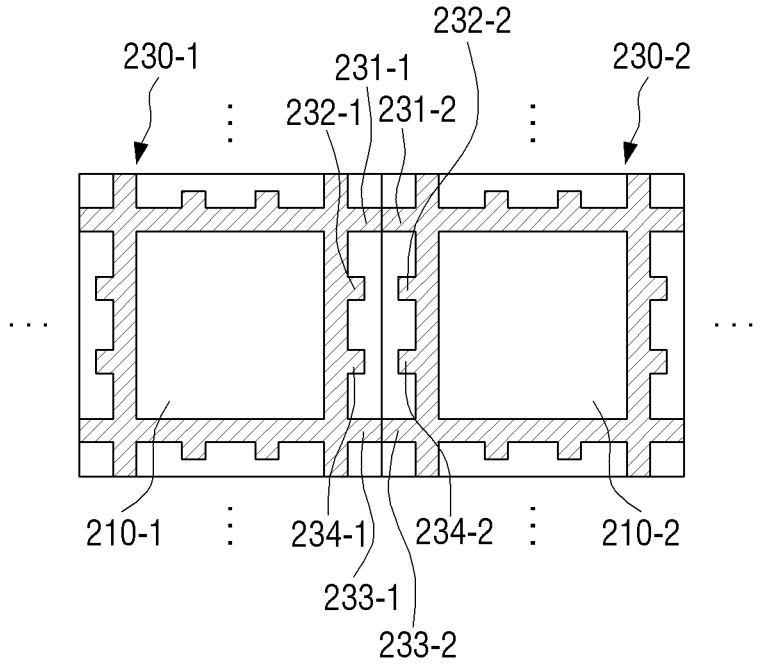
FIG. 4 is a plan view of an emission filter according to another exemplary embodiment.

FIG. 4 is a plan view of an emission filter according to another exemplary embodiment. Hereinbelow, an explanation related to portions overlapping the explanations made regarding FIG. 3 will be omitted.

FIG. 4 illustrates the first emission filter cell 230-1 and second emission filter cell 230-2, and herein the first emission filter cell 230-1 and second emission filter cell 230-2 are made in the same shape.

With reference to FIG. 4, at a right side of the first emission filter cell 230-1, a 1-1 inductor pattern portion 231-1 and 1-2 inductor pattern portion 233-1 are formed, while at a left side of the second emission filter cell 230-2, a 2-1 inductor pattern portion 231-2 and 2-2 inductor pattern portion 233-2 are formed. Since the first emission filter cell 230-1 and the second emission filter cell 230-2 are adjacent to each other, the 1-1 inductor pattern portion 231-1 and 2-1 inductor pattern portion 231-2, 1-2 inductor pattern portion 233-1 and 2-2 inductor pattern portion 233-2 are electrically connected to each other. Therefore, by the 1-1 inductor pattern portion 231-1 and 2-1 inductor pattern portion 231-2 electrically connected to each other, a first inductance is formed, and by the 1-2 inductor pattern portion 233-1 and 2-2 inductor pattern portion 233-2 electrically connected to each other, a second inductance is formed.

In addition, at a right side of the first emission filter cell 230-1, a 1-1 capacitor pattern portion 232-1 and 1-2 capacitor pattern portion 234-1 are formed, and at a left side of the second emission filter cell 230-2, a 2-1 capacitor pattern portion 232-2 and 2-2 capacitor pattern portion 234-2 are formed. The first emission filter cell 230-1 and second emission filter cell 230-2 are adjacent to each other, but the 1-1 capacitor pattern portion 232-1 and 2-1 capacitor pattern portion 232-2, and the 1-2 capacitor pattern portion 232-1 and 2-2 capacitor pattern portion 234-2 are electrically distanced from each other. Therefore, by the 1-1 capacitor pattern portion 232-1 and 2-1 capacitance pattern portion 232-2 electrically distanced from each other, a first capacitance is formed, and by the 1-2 capacitor pattern portion 234-1 and 2-2 capacitor pattern portion 234-2 electrically distanced from each other, a second capacitance is formed.

Figure 5:
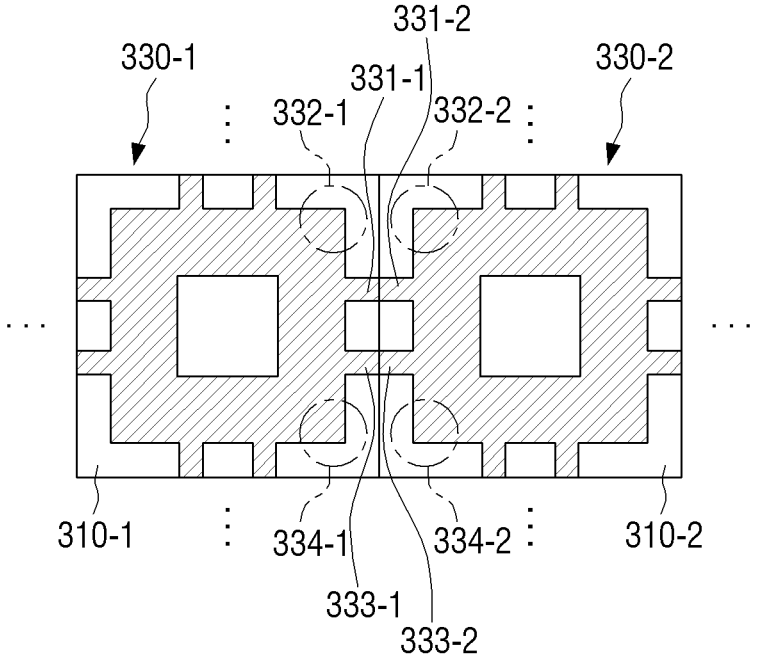
FIG. 5 is a plan view of an emission filter according to another exemplary embodiment.

FIG. 5 is a plan view of an emission filter according to another exemplary embodiment of the present disclosure.

FIG. 5 illustrates a first emission filter cell 330-1 and a second emission filter cell 330-2. The first emission filter cell 330-1 and the second emission filter cell 330-2 are made in the same shape.

With reference to FIG. 5, at a right side of the first emission filter cell 330-1, a 1-1 inductor pattern portion 331-1 and 1-2 inductor pattern portion 333-1 are formed, while at a left side of the second emission filter cell 330-2, a 2-1 inductor pattern portion 331-2 and 2-2 inductor pattern portion 333-2 are formed. Therefore, by the 1-1 inductor pattern portion 331-1 and 2-1 inductor pattern portion 331-2 being electrically connected, a first inductance is formed, and by the 1-2 inductor pattern portion 333-1 and 2-2 inductor pattern portion 333-2, a second inductance is formed.

In addition, at a right side of the first emission filter cell 330-1, a 1-1 capacitance pattern portion 332-1 and 1-2 capacitor pattern portion 334-1 are formed, and at a left side of the second emission filter cell 330-2, a 2-1 capacitor pattern portion 332-2 and 2-2 capacitor pattern portion 334-2 are formed. Herein, the capacitor pattern portion may be formed at a corner inside the emission filter cell, and electrically distanced from the adjacent capacitor pattern portion. Therefore, by the electrically distanced 1-1 capacitor pattern portion 332-1 and 2-1 capacitor pattern portion 332-3, a first capacitance may be formed, while the electrically distanced 1-2 capacitor pattern portion 334-1 and 2-2 capacitor pattern portion 334-2, a second capacitance may be formed.

Figure 6:
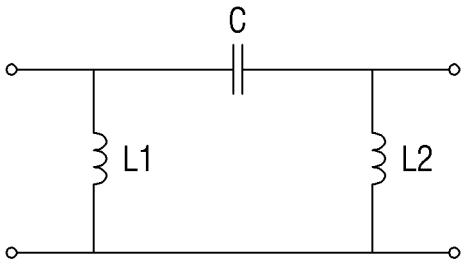
FIG. 6 is an equivalent circuit view of an emission filter cell according to an exemplary embodiment.

FIG. 6 is an equivalent circuit view of an emission filter cell according to an exemplary embodiment.

As aforementioned, among the adjacent emission filter cells according to various exemplary embodiments, at least one inductor pattern portion and capacitance pattern portion are included. Such an inductor pattern portion and a capacitor pattern portion may be expressed as an equivalent circuit of a capacitor C connected in parallel and inductors L1, L2 connected in series. With reference to the equivalent circuit view illustrated in FIG. 6, an emission filter cell according to an exemplary embodiment is embodied in a BSF (Band Stop Filter) where an inductor and capacitor are combined. The BSF is a filter blocking transmission of signals at a particular frequency, and thus an emission filter cell according to an exemplary embodiment plays the role of a BSF that blocks transmission of a signal at a particular frequency. That is, an emission filter cell may filter a surface wave caused by an emitter.

An electromagnetic signal emitted through an emitter cell may be leaked to an edge side of a substrate where an emitter cell is formed. Such leakage of an electromagnetic signal causes a surface wave and thus becomes a reason for deterioration of the performance of the emitter cell. Therefore, in response to an emission filter cell being disposed near an emitter cell, electromagnetic signals emitted through the emitter cell prevent leakage of electromagnetic signals by the emission filter cell that plays the role of a BSF. Thus, generation of a side lobe may be minimized and performance of the antenna may be improved.

Figure 7:
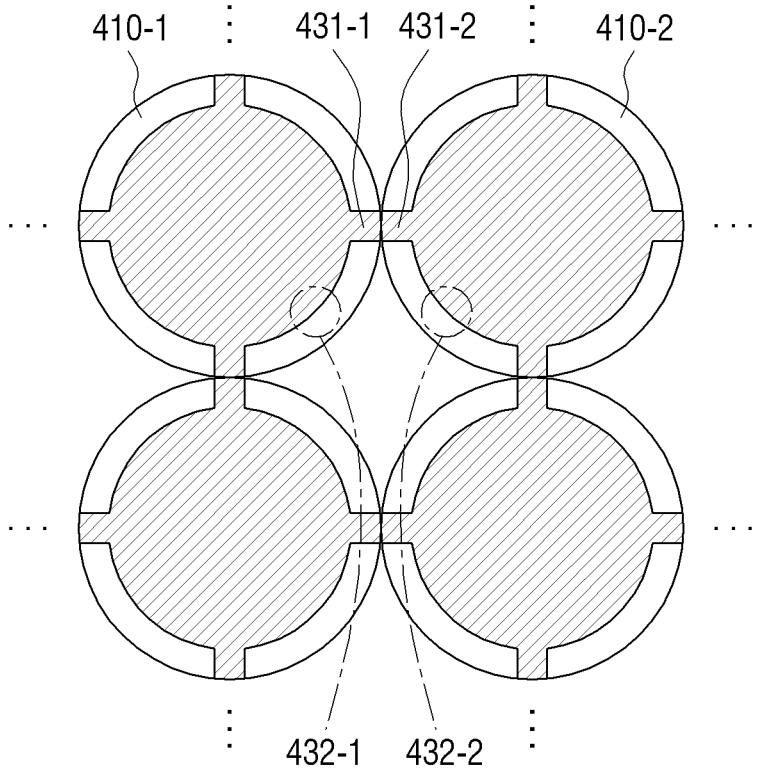
FIGS. 7 to 9 are plan views of an emission filter according to various exemplary embodiments.
Figure 8:
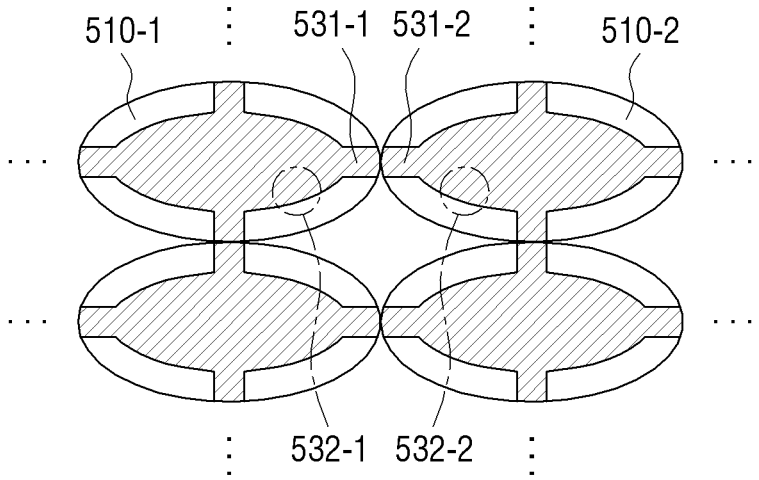
Figure 9:
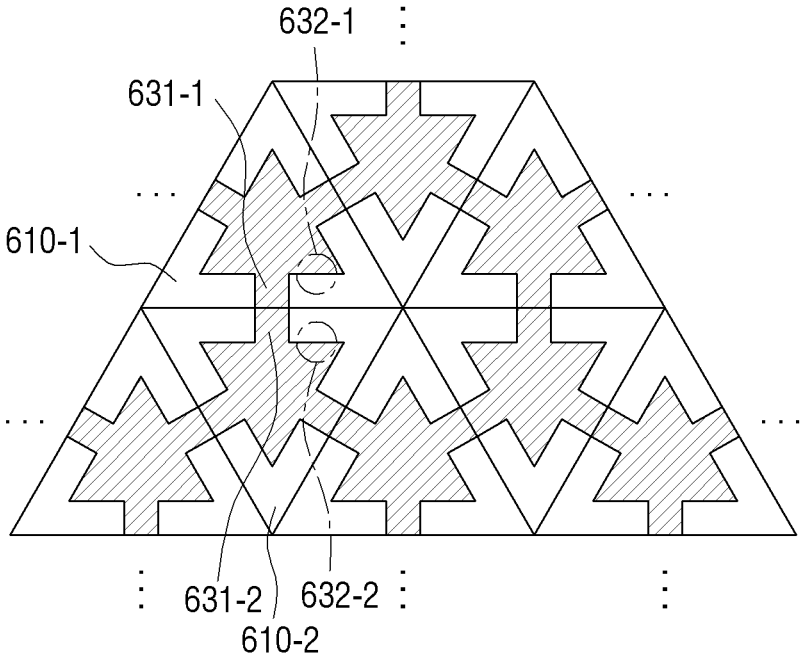

FIGS. 7 to 9 are plan views of an emission filter according to various exemplary embodiments.

With reference to FIGS. 7 to 9, an emission filter cell according to various exemplary embodiments may be at least one of a circular, oval or polygonal shape.

FIG. 7 illustrates a circular emission filter cell, FIG. 8 illustrates an oval emission filter cell, and FIG. 9 illustrates a triangular emission filter cell. However, other types of emission filter cells may also be embodied. An explanation of FIGS. 7 to 9 overlaps the explanation of FIGS. 3 to 5, and thus is omitted herein.

Figure 10:
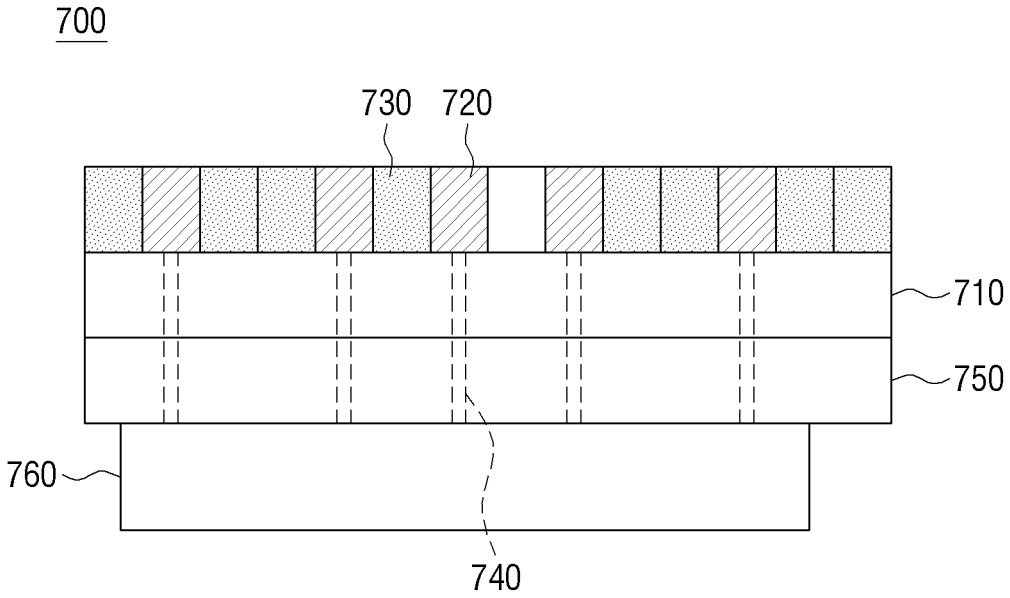
FIG. 10 is a cross-sectional view of an antenna according to an exemplary embodiment.

FIG. 10 is a cross-sectional view of an antenna 700 according to an exemplary embodiment. Hereinbelow, explanations on portions overlapping the aforementioned elements are omitted.

With reference to FIG. 10, an antenna 700, according to an exemplary embodiment includes a substrate 710, emitter, feeding portion 760, dielectric portion 750 and emission filter 730.

On the substrate 710, an emitter 720 and emission filter 730 are disposed. The emitter includes at least one emitter cell 720, and the emission filter may include a plurality of emission filter cells 730. In this case, as illustrated in FIG. 10, among a plurality of emission filter cells 730, an emitter cell 720 or emission filter cell 730 may be disposed, and in some cases, an emitter cell 720 or emission filter cell 730 may not be disposed among a plurality of emission filter cells 730.

The dielectric portion 750 may have a predetermined dielectric constant, and may be disposed between a lower portion of the substrate 710 and an upper portion of the feeding portion 760. That is, on the lower surface of the substrate 710 where at least one or more emitter cell 720 and a plurality of emission filter cells 730 are disposed on an upper surface, a dielectric portion 750 may be disposed, and to a lower surface of the dielectric portion 750, a feeding portion 760 may be connected.

In this case, a via hole may be formed on the substrate 710 and dielectric portion 750. Especially, the substrate 710 and dielectric portion 750 may be divided into an area where the emitter cell 720 is disposed an area where the emission filter cell 730 is disposed, and a via hole may be formed within the area where the emitter cell 720 is disposed. That is, within the area where the emitter cell 720 is disposed, a via hole may be formed regarding the vertical direction of the substrate 710 and dielectric portion 750.

The Via hole formed as aforementioned may be filled with conductive material which may electrically connect the feeding portion 760 and the emitter cell 720. The conductive material filling the via hole is called a feeding line, and the feeding line 740 may mean transmitting the electromagnetic energy output in the feeding portion 760 to the emitter. Therefore, the feeding line sends the electromagnetic energy output from the feeding portion 760 to the emitter cell 720, and each emitter cell 720 that received electromagnetic energy from the feeding line 740 may emit electromagnetic signals.

As illustrated in FIG. 10, among the plurality of emitter cells 720, emission filter cells 730 are preferably disposed, but is not limited thereto. That is, when necessary, an emission filter cell 730 may not be included among some emitter cells 720.

Figure 11:
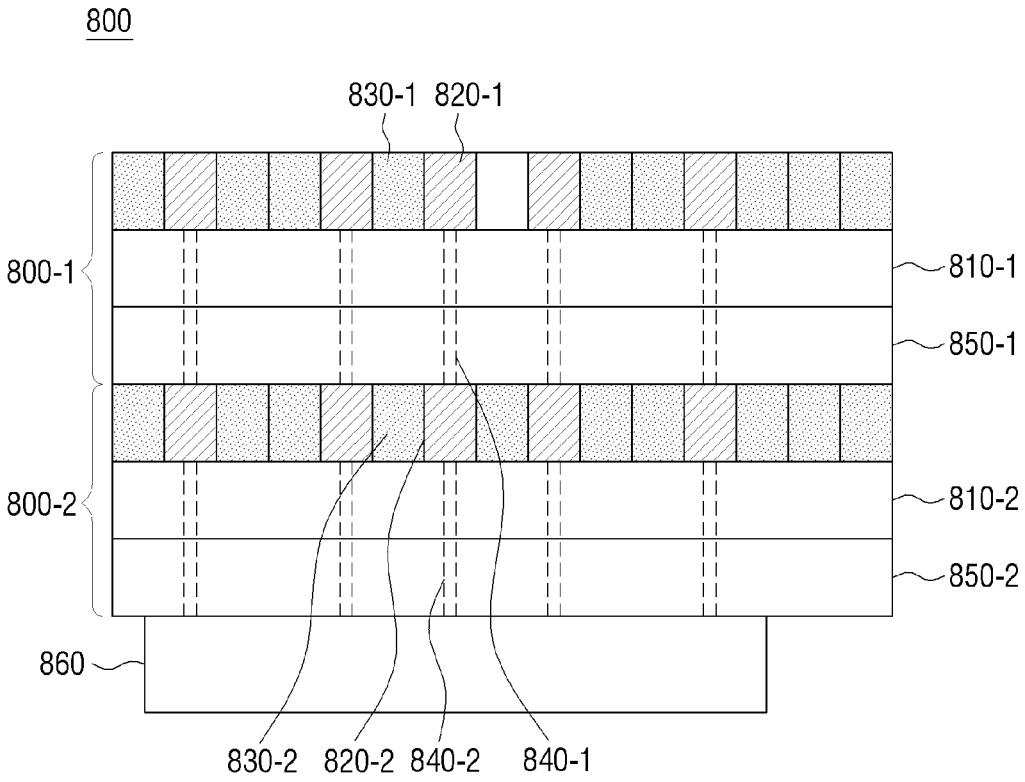
FIG. 11 is a cross-sectional view of an antenna according to another exemplary embodiment.

FIG. 11 is a cross-sectional view of an antenna according to another exemplary embodiment.

With reference to FIG. 11, an antenna 800 according to another exemplary embodiment may include a first antenna 800-1, second antenna 800-2, and feeding portion 860.

The feeding portion 860 is disposed on a lower surface of the second antenna 800-2. The first antenna 800-1 is deposited on top of the second antenna 800-2, in which case, the first antenna 800-1 and second antenna 800-2 may have the same structure. That is, each of the first antenna 800-1 and second antenna 800-2 having a same structure may be disposed on an upper layer and lower layer, respectively, and the first feeding lines 840-1 included in the first antenna 800-1 may each be electrically connected to the second emitter cells 820-2 included in the second antenna 800-2. Therefore, the electromagnetic energy output from the feeding portion 860 may be sequentially delivered to the second feeding line 840-2, the second emitter cell 820-2, the first feeding line 840-1 and the first emitter cell 820-1.

It is desirable that the first emitter cell 820-1 of the first antenna 800-1 and the second emitter cell 820-2 of the second antenna 800-2 are patterned in the same structure, but is not limited thereto. That is, the first emitter cell 820-1 may be circular, and the second emitter cell 820-2 may be polygonal.

In addition, although it is desirable that the first emitter cell 820-1 and the second emitter cell 820-2 are patterned in the same location, the exemplary embodiments are not limited thereto. Moreover, it is desirable that the first emission filter cell 830-1 and the second emission filter cell 830-2 are patterned in the same location, but are not limited thereto.

In addition, FIG. 11 illustrates a case where the first dielectric portion 850-1 is formed on a lower surface of the first antenna 800-1, but it is not limited thereto. That is, the second antenna 800-2 may include a second substrate 810-2 and second dielectric portion 850-2, and the first antenna 800-1 may include only the first substrate 810-1.

In addition, FIG. 11 illustrates a case where the first antenna 800-1 and second antenna 800-2 are deposited, but it is not limited thereto. That is, an antenna according to another exemplary embodiment may be one that is formed where two or more antennas have been deposited.

Other portions are the same as FIG. 10, and thus further explanation is omitted.

Figure 12:
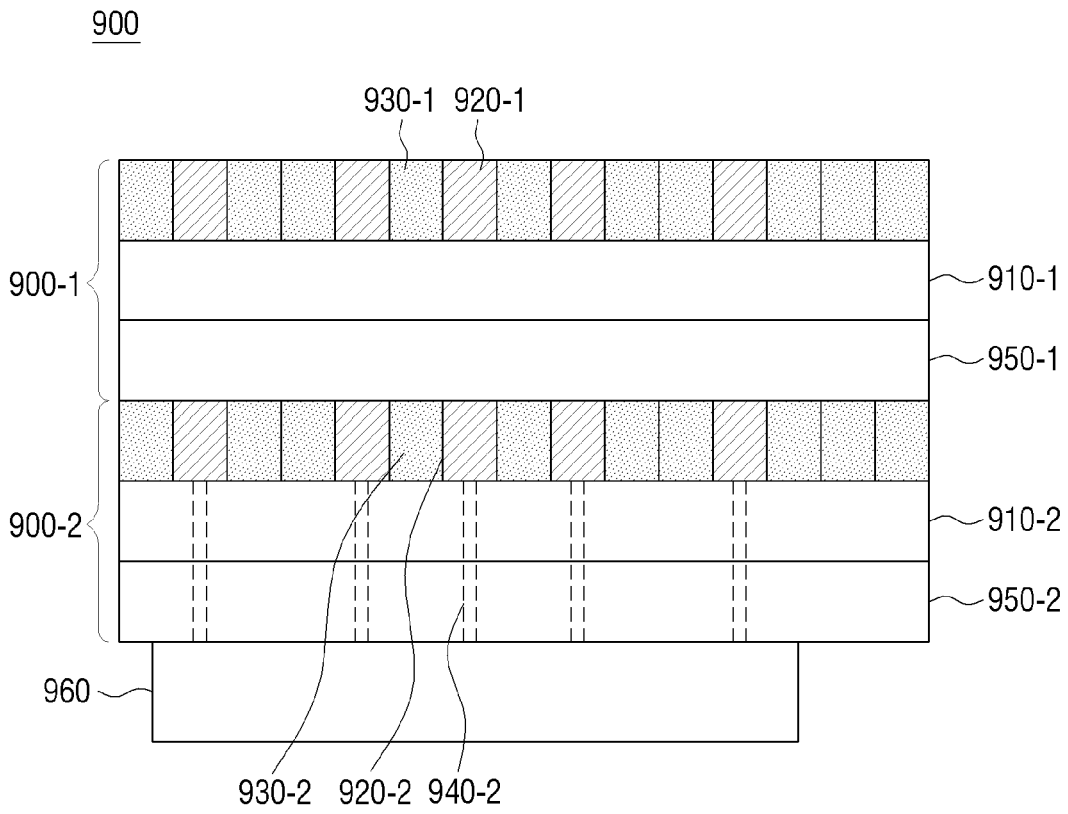
FIG. 12 is a cross-sectional view of an antenna according to another exemplary embodiment.

FIG. 12 is a cross-sectional view of an antenna according to another exemplary embodiment.

With reference to FIG. 12, on the second substrate 910-2 and second dielectric portion 950-2 included in the second antenna 900-2, a second feeding line 940-2 may be formed, and on the first substrate 910-1 and first dielectric portion 950-1 included in the first antenna 900-1, a feeding line may not be formed. According to FIG. 12, the electromagnetic energy output from the feeding portion 960 is delivered to the second feeding line 940-2 and second emitter cell 920-2. In this case, the electromagnetic energy delivered to the second emitter cell 920-2 may not be delivered to the first emitter cell 920-1 through the feeding line, but rather through the emission of electromagnetic energy.

FIG. 12 illustrates a case where a feeding line is not formed on the first substrate 910-1 and first dielectric portion 950-1 of the first antenna 900-1, but it is not limited thereto. That is, a feeding line may be formed on only one of the first substrate 910-1 and the first dielectric portion 950-1. Otherwise, a feeding line may be formed only on an area corresponding to a portion of the plurality of emitter cells.

Other portions are the same as the explanation made with reference to FIGS. 10 and 11, and thus further explanations are omitted.

Figure 13:
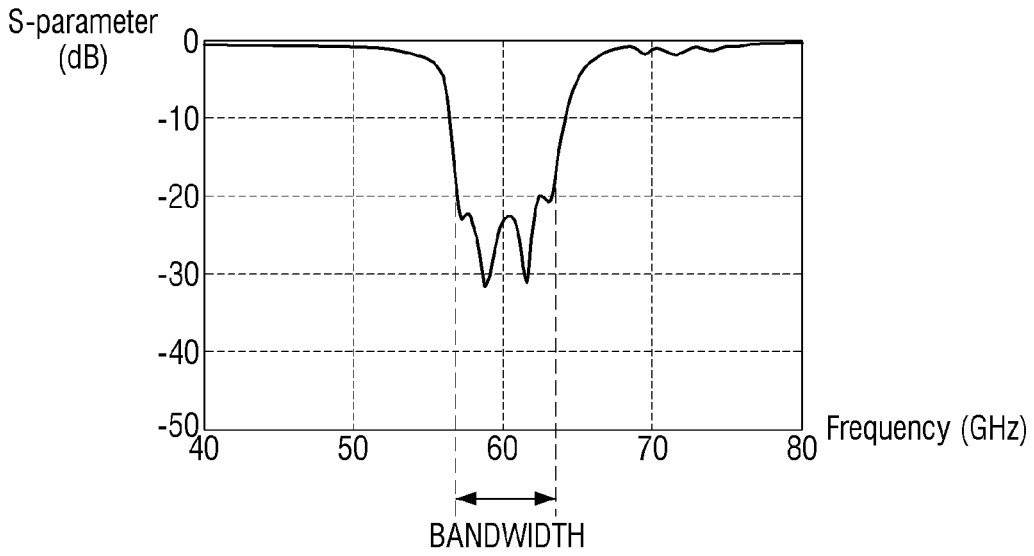
FIG. 13 is a characteristic graph of an emission filter according to an exemplary embodiment.

FIG. 13 is a characteristic graph of an emission filter according to an exemplary embodiment.

It has already been explained with reference to FIG. 6 that an emission filter according to various exemplary embodiments plays the role of a Band Stop Filter. That is, an emission filter cell according to various exemplary embodiment may play the role of a band stop filter which blocks the signal that an emitter cell emits at a particular frequency. Therefore, as illustrated in FIG. 13, an emission filter cell may have a characteristic of blocking the frequency included in the bandwidth of a particular frequency from leaking to an side edge of the substrate. Therefore, when an emission filter cell is disposed near an emitter cell, the electromagnetic signal emitted through the emitter cell prevents leakage of electromagnetic signals by the emission filter cell that plays the role of a BSF. Accordingly, generation of a side lobe is minimized and the performance of the antenna may be improved.

Figure 14:
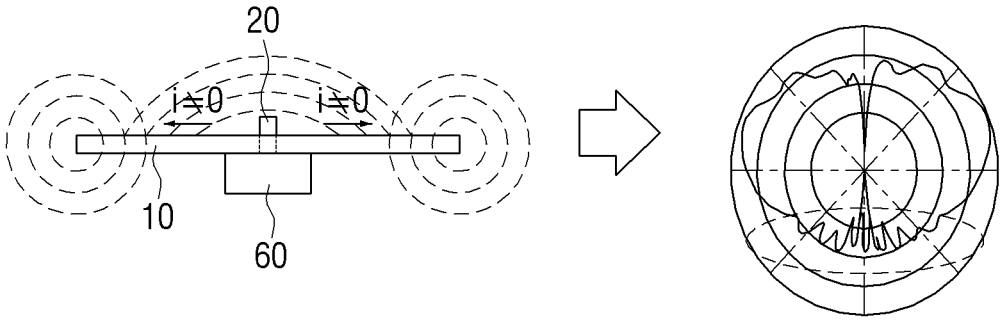
FIG. 14 (RELATED ART)
FIG. 14 is a cross-sectional view of an antenna of the related art and an emission pattern view thereof.
Figure 15:
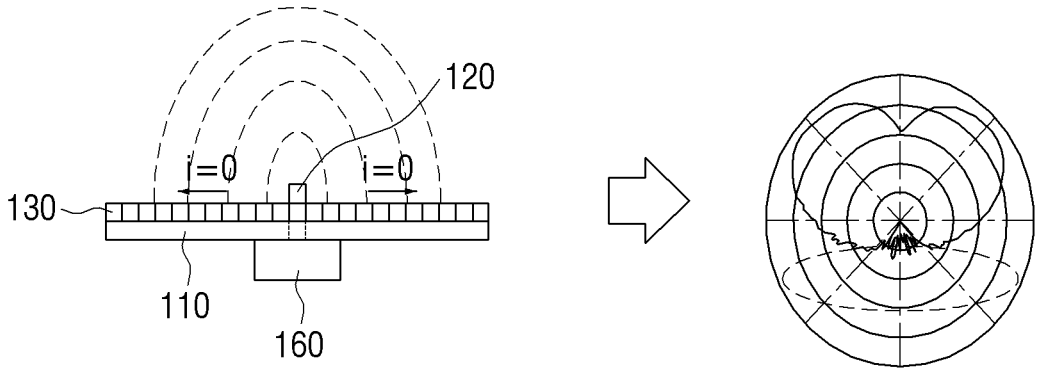
FIG. 15 is a cross-sectional view of an antenna of the related art and an emission pattern view thereof according to an exemplary embodiment of the present disclosure.

FIG. 14 is a cross-sectional view of an antenna of the related art and an emission pattern view thereof; and FIG. 15 is a cross-sectional view of an antenna of the related art and an emission pattern view thereof according to an exemplary embodiment.

According to technology of the related art, as illustrated in FIG. 14, a portion of the electromagnetic signals emitted from the antenna is leaked to the edge side of the substrate 10, and thus a surface wave is formed. In FIG. 14 i± refers to signal leakage to the side ends of the substrate. However, as illustrated in FIG. 15, according to an antenna according to another exemplary embodiment, the electromagnetic signals leaked to the edge side of the substrate 110 may be minimized, and desirably, the electromagnetic signals leaked to the edge side of the substrate 110 may be Zero as shown by i=0 in FIG. 15. That is, since generation of a side lobe is minimized, it is possible to maximize generation of a main lobe. Therefore, the performance of the antenna may be improved.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An antenna comprising:

a substrate having a first surface and a second surface;

a radiator on the first surface of the substrate configured to emit electromagnetic signals;

a feeding portion connected to the radiator; and a filter comprising a plurality of filter cells formed on the first surface of the substrate and configured to filter a surface wave caused by the radiator, wherein each of the plurality of filter cells comprises an inductor pattern portion physically connected with an adjacent filter cell on the first surface of the substrate to form an inductor; and a capacitor pattern portion disposed between inductor pattern portions, and distanced from a capacitor pattern portion of the adjacent filter cell on the first surface of the substrate to form a capacitor, wherein the filter, the radiator, the inductor pattern portion and the capacitor pattern portions are placed on the first surface of the substrate.

2. The antenna according to claim 1, wherein the plurality of filter cells comprises a conductive pattern of a same shape formed on the first surface of the substrate.

3. The antenna according to claim 1, wherein the radiator comprises a plurality of radiator cells formed on the first surface of the substrate, and at least one filter cell from among the plurality of filter cells being arranged among the plurality of radiator cells.

4. The antenna according to claim 3, wherein the radiator is formed in a via hole formed on the substrate.

5. The antenna according to claim 1, wherein the substrate is a plurality of substrates deposited on top of one another, the radiator comprises a plurality of radiator cells, the antenna further comprises:

a dielectric portion formed among the plurality of substrates;

a via hole formed inside the dielectric portion; and a feeding line formed inside the via hole to electrically connect an upper radiator cell located in an upper side of the dielectric portion and a lower radiator cell located in a lower side of the dielectric portion.

6. The antenna according to claim 1, wherein the substrate is a plurality of substrates deposited on top of one another, the radiator comprises a plurality of radiator cells, and the antenna further comprises a dielectric portion formed among the plurality of substrates.

7. The antenna according to claim 1, wherein each of the plurality of filter cells is one of a circular, oval or polygonal shape.

8. A filter comprising:

a substrate having a first surface and a second surface; and a plurality of filter cells configured in a conductive pattern on the first surface of the substrate, in order to filter a surface wave caused by a radiator on the first surface of the substrate, wherein each of the plurality of filter cells comprises an inductor pattern portion physically connected with an adjacent filter cell on the first surface of the substrate to form an inductor; and a capacitor pattern portion disposed between induction pattern portions, and distanced from a capacitor pattern portion of the adjacent filter cell on the first surface of the substrate to form a capacitor, wherein the filter, the radiator, the inductor pattern portion and the capacitor pattern portions are placed on the first surface of the substrate.

9. The filter according to claim 8, wherein the plurality of filter cells comprise a conductive pattern of a same shape formed on the substrate surface.

10. The filter according to claim 8, wherein each of the plurality of filter cells is one of a circular, oval or polygonal shape.

11. An antenna comprising:

a substrate;

a radiator configured to emit electromagnetic signals; and a filter comprising a plurality of filter cells functioning as a band stop filter and configured to filter a surface wave caused by the radiator, the filter and the radiator being formed on a same surface of the substrate, wherein each of the plurality of filter cells comprises an inductor pattern portion physically connected with an adjacent filter cell on the surface of the substrate to form an inductor; and a capacitor pattern portion disposed between induction pattern portions, and distanced from a capacitor pattern portion of the adjacent filter cell on the surface of the substrate to form a capacitor, wherein the filter, the radiator, the inductor pattern portion and the capacitor pattern portions are placed on the surface of the substrate.

12. The antenna of claim 11, wherein the substrate is a plurality of substrates deposited on top of one another.

13. The antenna of claim 11, wherein the radiator is formed on the substrate.

14. The antenna of claim 11, further comprising a feeding portion connected to the radiator.

15. The antenna of claim 11, wherein the plurality of filter cells are formed on the substrate in order to filter a surface wave caused by the radiator.

16. The antenna of claim 12, wherein the antenna further comprises a dielectric portion formed among the plurality of substrates.

17. The antenna of claim 11, wherein each of the plurality of filter cells is one of a circular, oval or polygonal shape.

18. The antenna according to claim 16, wherein the radiator is formed in a via hole formed on the substrate.

19. The antenna according to claim 18, further comprising a feeding line formed inside the via hole to electrically connect an upper radiator cell located in an upper side of the dielectric portion and a lower radiator cell located in a lower side of the dielectric portion.

* * * * *